US007982561B2

(12) United States Patent
Mendenhall

(10) Patent No.: US 7,982,561 B2
(45) Date of Patent: Jul. 19, 2011

(54) RESONATOR SYSTEM FOR AN RF POWER AMPLIFIER OUTPUT CIRCUIT

(75) Inventor: Geoffrey Norman Mendenhall, Cincinnati, OH (US)

(73) Assignee: Harris Corporation, Melbourne, FL (US)

( * ) Notice: Subject to any disclaimer, the term of this patent is extended or adjusted under 35 U.S.C. 154(b) by 501 days.

(21) Appl. No.: 12/231,745

(22) Filed: Sep. 5, 2008

(65) Prior Publication Data

US 2010/0060387 A1 Mar. 11, 2010

(51) Int. Cl.
*H01P 7/00* (2006.01)

(52) U.S. Cl. ..... 333/224; 333/227; 333/232; 333/219

(58) Field of Classification Search ..... 333/224, 333/227, 232, 233, 219
See application file for complete search history.

(56) References Cited

U.S. PATENT DOCUMENTS 4,734,665 A * 3/1988 Rosenberg et al. ..... 333/212
5,986,526 A * 11/1999 Kopal et al. ..... 333/232

* cited by examiner

*Primary Examiner* — Dameon E Levi
*Assistant Examiner* — Hardadi Sumadiwirya
(74) *Attorney, Agent, or Firm* — Tarolli, Sundheim, Covell & Tummino LLP

(57) ABSTRACT

A resonator system is presented that has first and second cavity resonators for use in an RF amplifying system employing an RF amplifier device having an output circuit and an RF signal broadcasting antenna coupled to the output circuit. The resonators are interposed between the amplifying device output terminal and the antenna. The first resonator is comprised of a transmission line being a length of two coaxial conductors and tuned to the 3$^{rd}$ harmonic of the operating frequency (3fo). Each resonator has first and second opposing ends with the first end being an open end and the second end being a shorted end. The open end of the first resonator is connected to the output terminal of the RF amplifying device. The second resonator is connected in series with the first resonator and is tuned to the fundamental operating frequency (fo).

10 Claims, 5 Drawing Sheets

RESONATOR SYSTEM FOR AN RF POWER AMPLIFIER OUTPUT CIRCUIT

FIELD OF THE INVENTION

This invention is directed to RF broadcast and communication systems and is particularly related to improving the efficiency of RF power amplifiers.

BACKGROUND OF THE INVENTION

It has been known in the art to employ a lumped "LC" parallel-tuned circuit third harmonic resonator in series with the output terminal of a power amplifier device intermediate the output terminal and a broadcasting antenna. The efficiency of an "LC" resonator is not as great as desired, particularly at VHF and higher frequencies due to circuit losses, stray reactances and undesired resonances, hence, such a "LC" resonator is not practical at these higher frequencies. It is desirable, therefore, to provide an improved third harmonic resonator for use in the output circuit of such an RF amplifying system and located between the RF amplifier device and the output circuit which provides an RF signal to the broadcasting antenna.

SUMMARY OF THE INVENTION

In accordance with one aspect of the present invention, a succession of two cavity resonators is provided as the output circuit in an RF amplifying system for feeding a broadcasting antenna. The first of two resonators is interposed between the output terminal of the RF amplifier device (Vacuum Tube or Transistor) and the open end of the second, output circuit resonator. The first resonator is tuned to the $3^{rd}$ harmonic of the operating frequency (3fo). The second resonator is tuned to the fundamental operating frequency (fo). Both resonators are coaxial transmission lines. The first resonator is formed by a length of coaxial conductors having first and second opposing ends with the first end being an open end and the second end being a shorted end. The open first end of the first resonator is connected to the output terminal of the RF amplifier device.

In accordance with a more limited aspect of the present invention, the first resonator is a cavity resonator in that a portion of the length of an inner conductor is spaced from and surrounded by a portion of the length of an outer conductor, creating a cavity between the conductors. Parts of the conductors are slidable relative to each other to achieve a variation in the resonant frequency.

BRIEF DESCRIPTION OF THE DRAWINGS

The foregoing and other features of the present invention will become apparent to one skilled in the art to which the present invention relates upon consideration of the following description of the invention with reference to the accompanying drawings, wherein.

DESCRIPTION OF PREFERRED EMBODIMENTS

This invention may be used to increase the operating efficiency of an RF power amplifier, by reducing the third harmonic current component in the output waveform of the amplifier. This invention provides a high impedance to the third harmonic current component on the output terminal (anode, drain, collector) of the RF power amplifying device which reduces the amount of power wasted in the third harmonic content. This invention also increases the transition slope of the output waveform which improves the switching efficiency of the output device by reducing the switching transition time spent in the active, series "on" resistance, area of the output device.

The embodiment of the invention presented herein utilizes a ¼ wavelength transmission line segment at three times the fundamental operating frequency (3fo) which is shorted at one end and open at the other end creating a resonant circuit at the third harmonic of the power amplifier's operating frequency. The impedance at the open end of this coaxial transmission line segment is very high at the third harmonic of the fundamental operating frequency while simultaneously providing a low, inductive, impedance at the fundamental, operating frequency.

Figure 1:
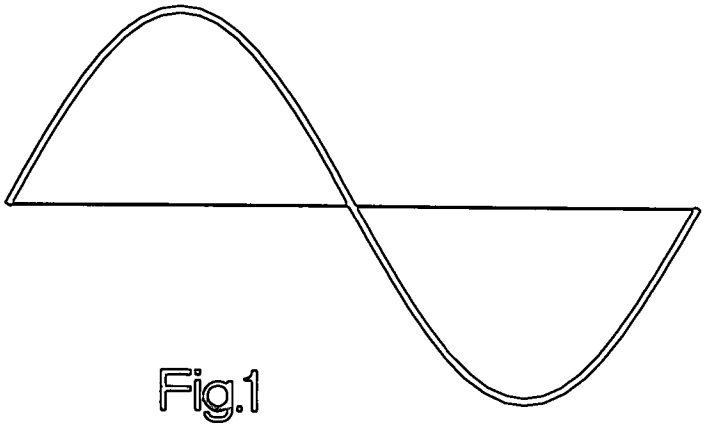
FIG. 1 is a graphical image of voltage with respect to time illustrating a quasi-sinusoidal waveform on the output terminal of a power amplifier device.
Figure 2:
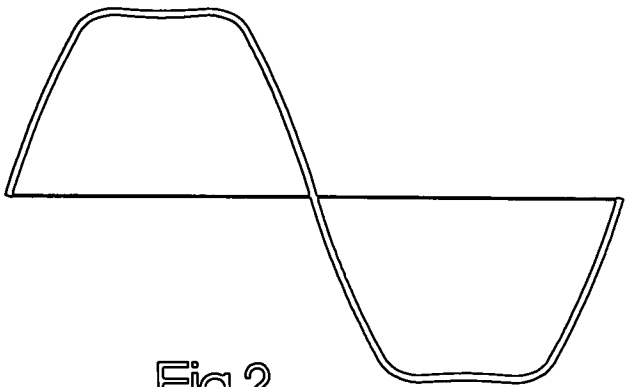
FIG. 2 is a graphical waveform similar to that of FIG. 1, but showing the third harmonic efficiency-enhanced waveform obtained with the present invention on the output terminal of a power amplifier device.

This transmission line segment is placed with the open end located at the output terminal of the amplifying device which places it in series between the output terminal of the amplifying device and the input terminal of the fundamental frequency, ¼ wavelength resonant cavity output circuit of the RF power amplifier. Placing a high impedance at the third harmonic frequency in series with the output device changes the voltage waveform on the output terminal of the power amplifying device from the quasi-sinusoidal waveform shown in FIG. 1 to the more square wave like waveform shown in FIG. 2 which has faster rise and fall times. FIGS. 3-8 show the embodiment of this invention in a VHF power amplifier cavity for an FM transmitter.

Reference is now made to FIGS. 3-8 which illustrate, in detail, the electrical and mechanical features of the cavity resonator system employing the present invention. As is well known, a cavity resonator may be defined as any region bounded by conducting walls within which resonant electromagnetic fields may be excited. The first or inner cavity resonator disclosed herein may be referred to as a third harmonic stub resonator and, as shown in the drawings, includes a transmission line which is a length of two coaxial conductors including an inner conductor 18 of the fundamental output cavity resonator 20 and an outer conductor 22 of the $3^{rd}$ harmonic coaxial cavity resonator 23. These conductors are cylindrical in shape with the outer conductor coaxially surrounding and being radially spaced from the inner conductor so as to define the $3^{rd}$ harmonic cavity 24 therebetween. The length of the cavity is adjustable and is on the order of ¼ wavelength of the 3rd harmonic frequency and 1/12 wavelength of the fundamental operating frequency.

The structure noted above is located within a metal (aluminum) housing 21 which provides the outer conductor of the second resonator 20. The vertical walls of the housing are spaced from conductor 18 of the inner resonator 20 to define a cavity 25 therebetween.

Figure 3:
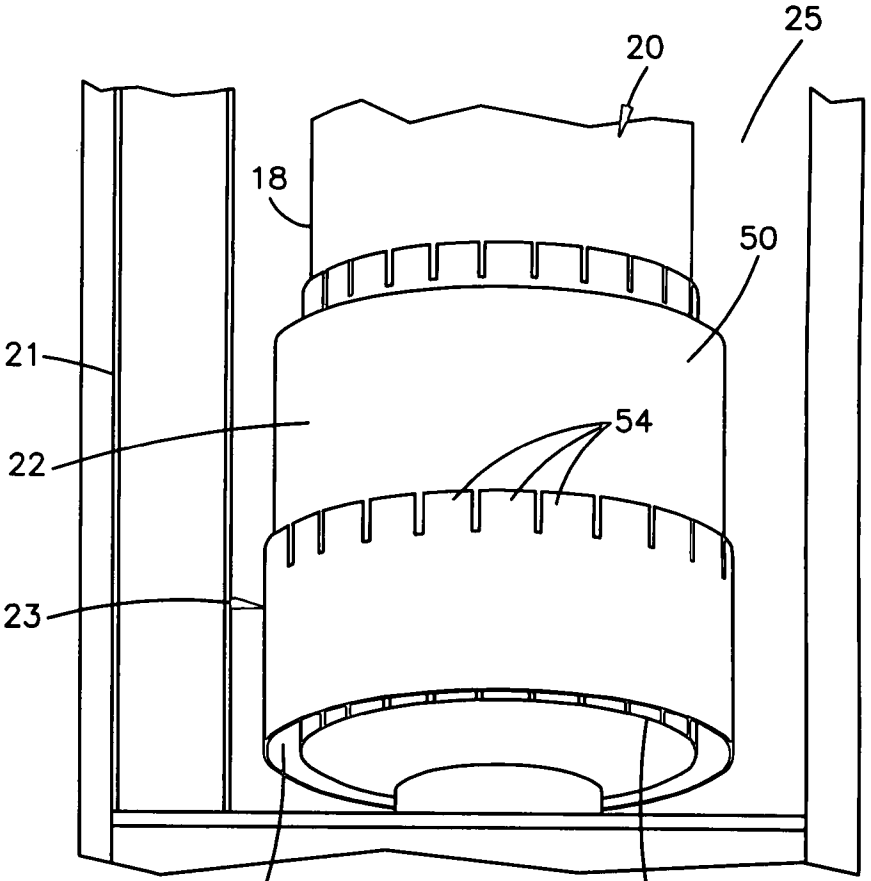
FIG. 3 is a perspective view with parts broken away illustrating a resonator system in accordance with the present invention located in a housing which is the outer conductor of the output circuit cavity and looking in a slightly upward direction at the resonator system.
Figure 5:
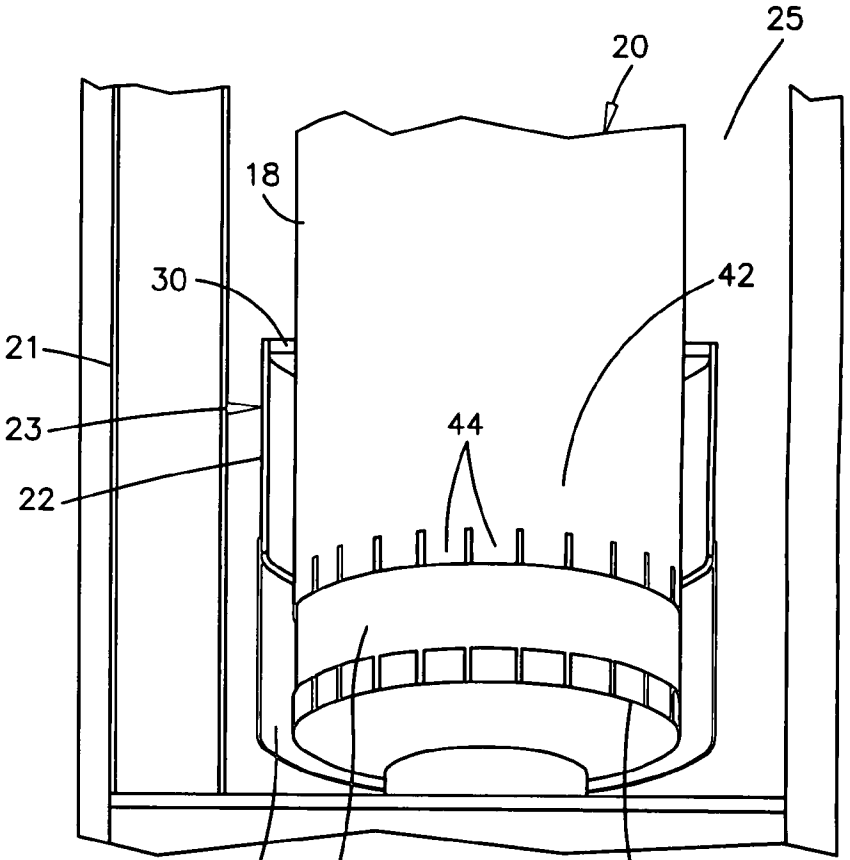
FIG. 5 is a view similar to that of FIG. 3, but showing parts broken away from the outer conductor.
Figure 4:
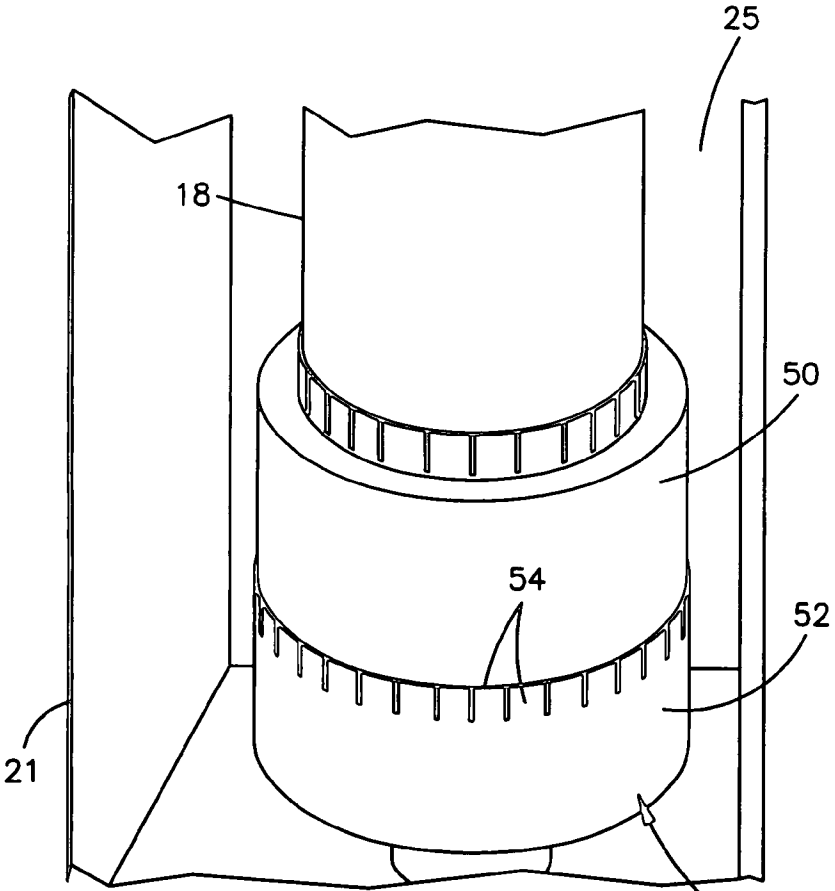
FIG. 4 is a perspective view similar to that of FIG. 3, but looking in a slightly downward direction.
Figure 6:
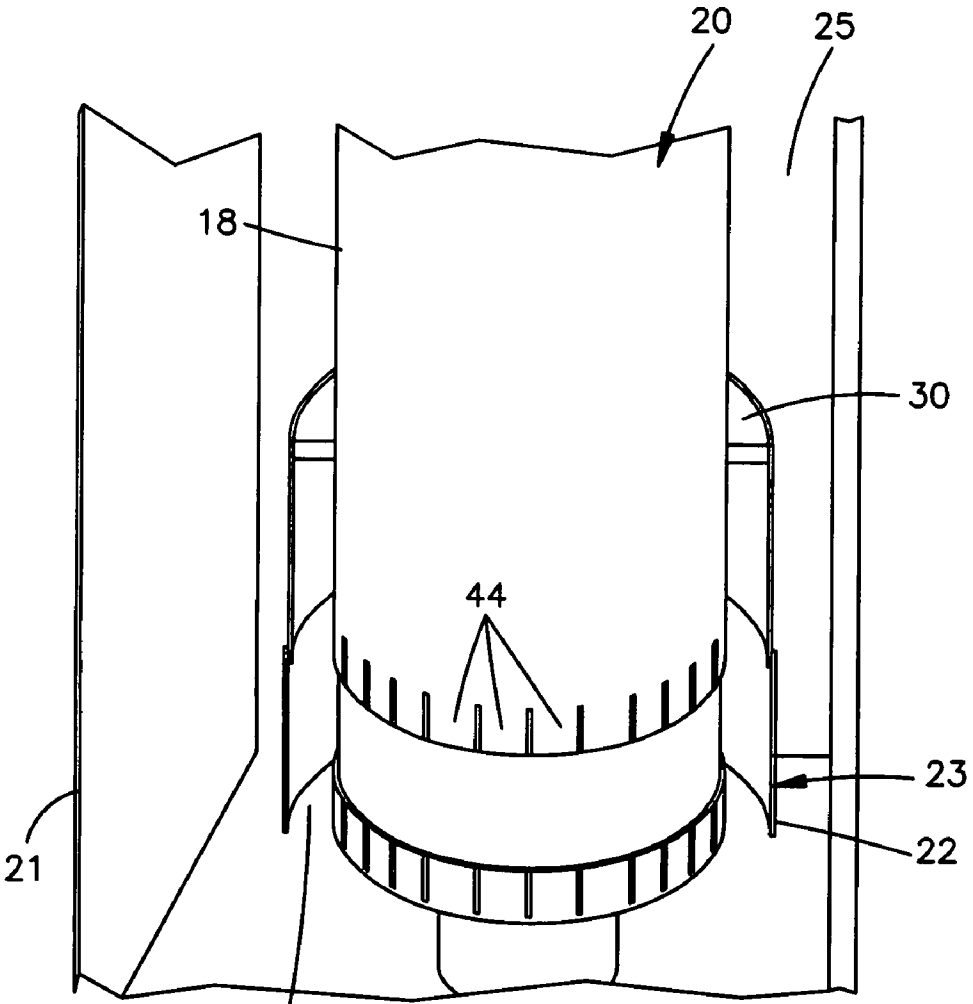
FIG. 6 is a view similar to that of FIG. 4, but showing parts broken away.

As shown in FIG. 3, the lower end of the inner resonator cavity 23 is open with the inner conductor 26 being connected to the anode or output circuit of the amplifier tube to which the resonator is coupled to. The upper end of the outer conductor 22 is closed and this is best shown in FIGS. 5 and 6 wherein it is seen that the upper end is provided with a metal ring 30 which extends between the upper end of the outer conductor 22 and the inner conductor 18. The metal ring 30 is connected, as by welding or the like, to the inner conductor 18 and to outer conductor 22. This then provides the upper closed end of the first or inner 3rd harmonic cavity resonator 23.

Figure 7:
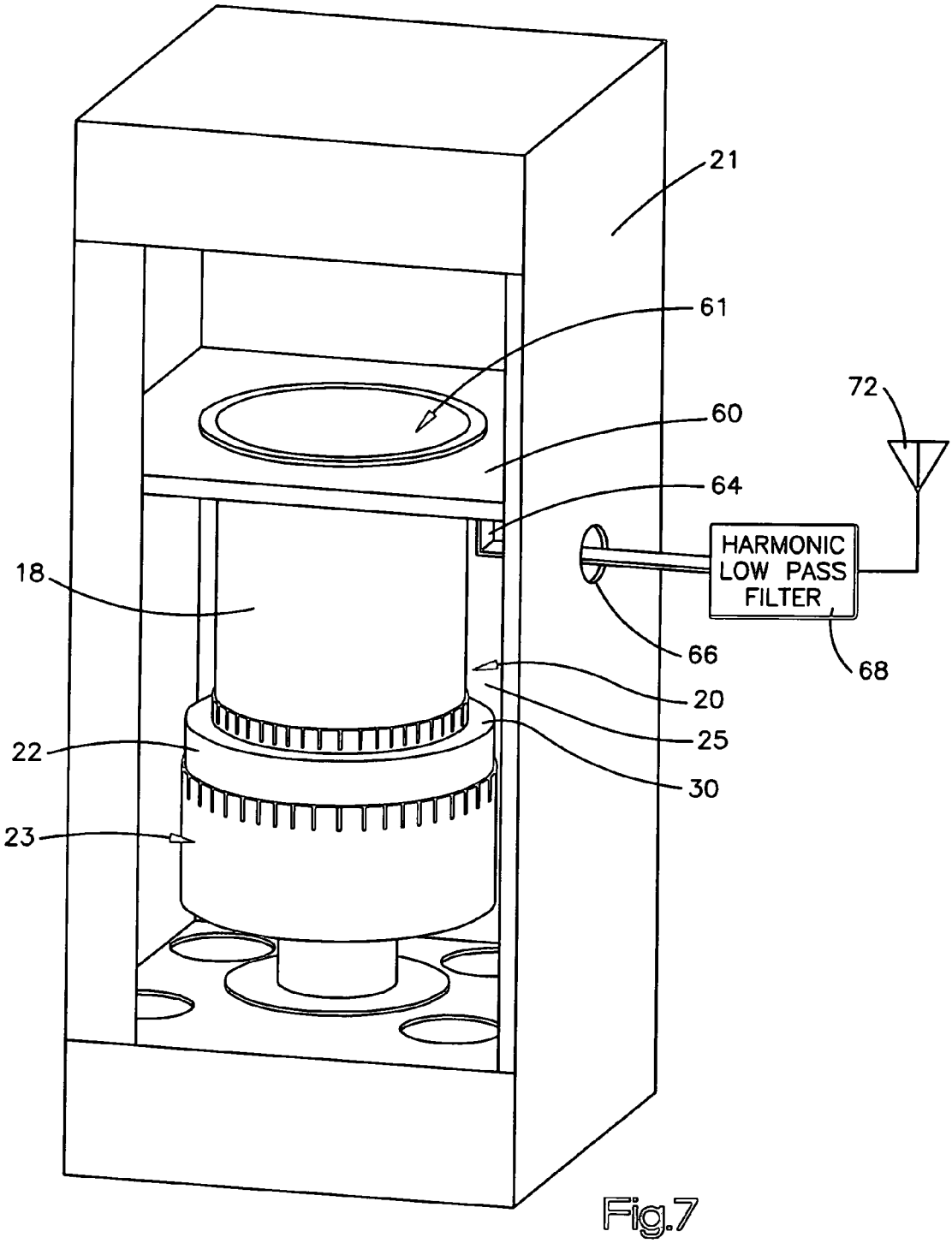
FIG. 7 is an enlarged view similar to FIG. 6 but showing more detail of the upper portion not illustrated in FIG. 6.

It should be noted that conductor 18 of resonator 20 is electrically connected by shorting ring 30 to the conductor 22 of resonator 23 and both serve as the inner conductor of resonator 20. These conductors are surrounded by the walls of housing 21 to define resonator 20 with a cavity 25 therebetween. As best seen in FIG. 7, resonator 20 may be tuned by moving shorting plate 60 up and down within the housing. This plate shorts the open end 61 of the resonator between conductor 18 and the walls of the housing 21.

The 3rd harmonic cavity resonator is tunable by effectively adjusting the length of the cavity 24. This is achieved with the structure described below.

The inner conductor 18 is a two-part device, in that it includes a first segment 40 of circular cross-section and a second segment 42 of circular cross-section that coaxially surrounds a portion of the length of the first segment 40. The lower end of the second segment 42 is provided with an annular array of fingers 44 which make frictional and electrical engagement with the outer surface of segment 40. This relationship is such that segment 42 may be displaced relative to segment 40 in an axial direction. In a similar manner, the outer conductor 22 has a first segment 50 of circular cross-section and a second segment 52 of circular cross-section that coaxially surrounds a portion of the length of the first segment of the outer conductor. It is to be noted that the upper portion of segment 52 is provided with a plurality of fingers 54 that frictionally and electrically engage the outer surface of segment 50. This permits segment 52 to be displaced relative to segment 50 in an axial direction. Consequently, the cavity 24 may be expanded or shortened in an axial direction by movement of these segments relative to each other. If the length of the cavity 24 is shortened, this will increase the resonant frequency of the cavity. Similarly, if the length of the cavity is decreased, this will lower the resonant frequency of the cavity.

Figure 8:
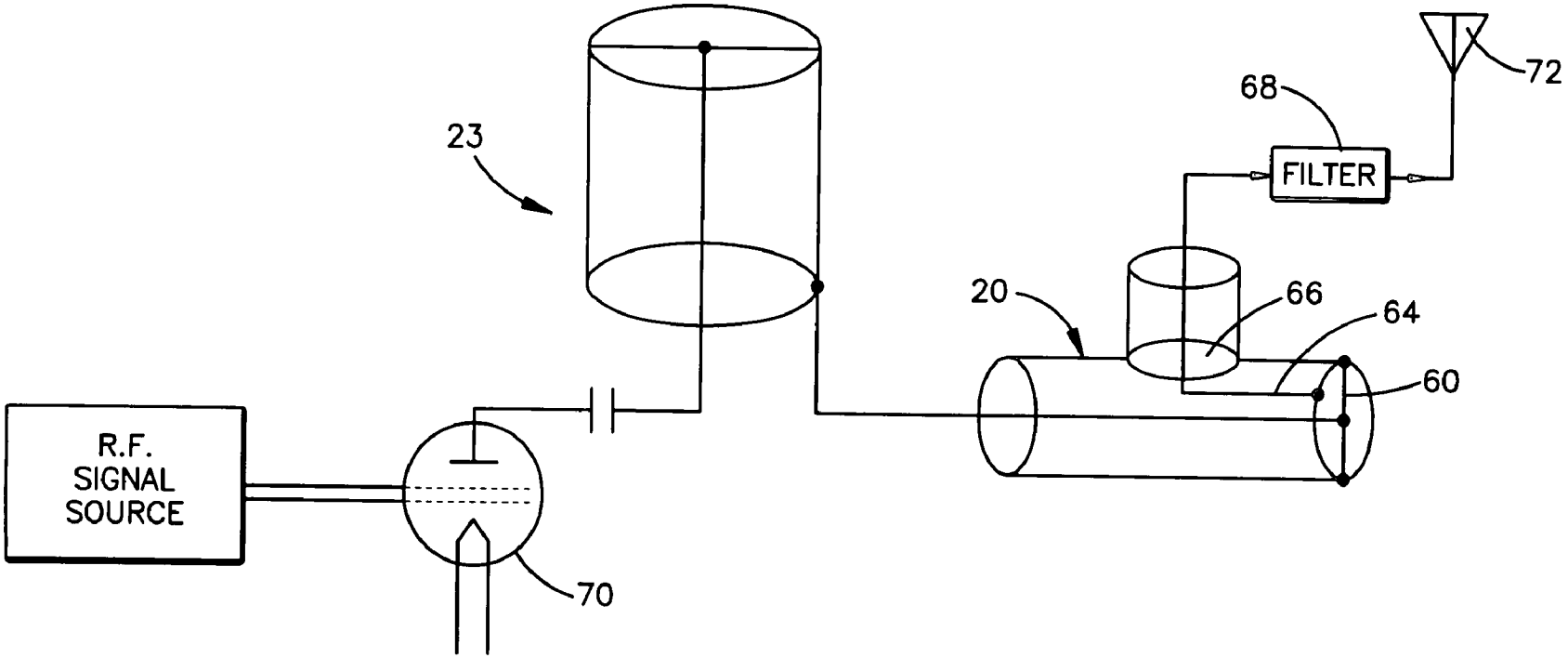
FIG. 8 is a schematic-block diagram illustration of the resonator system.

Reference is now made to the circuit diagram of FIG. 8 for another representation of this embodiment of the invention. As noted herein, this embodiment of the invention includes two cavity resonators 20 and 23 that are electrically connected in series between an amplifying device 70 and an antenna 72. The shorting plate 60 (FIG. 7) of the resonator 20 is electrically connected to one end of an output coupling loop 64 that extends through a suitable opening 66 in a sidewall of housing 21 and thence to antenna 72 by way of a harmonic low pass filter 68.

Although the invention has been described in conjunction with a preferred embodiment, it is to be appreciated that various modifications may be made without departing from the spirit and scope of the invention as defined by the appended claims.

Having described the invention, I claim:

1. A resonator system employing first and second cavity resonators for use in an RF amplifying system comprising an RF amplifier device having an output circuit and an RF signal broadcasting antenna coupled to said output circuit, said resonators being interposed between the amplifying device output terminal and said antenna, said first resonator being comprised of a transmission line being a length of two coaxial conductors and tuned to the 3rd harmonic of an operating frequency (3fo), each said resonator having first and second opposing ends with said first end being an open end and said second end being a shorted end, said open end of said first resonator is connected to said output terminal of said RF amplifying device, said second resonator is connected in series with said first resonator and is tuned to the fundamental operating frequency (fo).

2. A resonator system as set forth in claim 1 wherein said first and second resonators are of different lengths.

3. A resonator system as set forth in claim 1 wherein the open end of said second resonator is connected to the closed end of said first resonator.

4. A resonator as set forth in claim 1 wherein the first resonator is coaxially located within said second resonator.

5. A resonator system as set forth in claim 1 wherein said coaxial conductors of said first resonator include an outer conductor and an inner conductor and wherein said shorted end has said inner conductor being electrically shorted to said outer conductor.

6. A resonator system as set forth in claim 5 wherein said inner conductor includes a first segment of circular cross-section and a second segment of circular cross-section that coaxially surrounds a portion of the length of said first segment.

7. A resonator system as set forth in claim 6 wherein said first and second segments of said inner conductor are axially slidable relative to each other for tuning said first resonator.

8. A resonator system as set forth in claim 6 wherein said outer conductor includes a first segment of circular cross-section and a second segment of circular cross-section that coaxially surrounds a portion of the length of said first segment of said outer conductor.

9. A resonator system as set forth in claim 8 wherein said first and second segments of said outer conductor are axially slidable relative to each other for tuning said first resonator.

10. A resonator system as set forth in claim 6 including a metal ring that mechanically and electrically interconnects one end of said outer conductor to said inner conductor to provide said closed end providing said shorted circuit.

* * * * *